US007224313B2

(12) United States Patent
McKinzie, III et al.

(10) Patent No.: US 7,224,313 B2
(45) Date of Patent: May 29, 2007

(54) MULTIBAND ANTENNA WITH PARASITICALLY-COUPLED RESONATORS

(75) Inventors: William E. McKinzie, III, Fulton, MD (US); James Y. Scott, Owings Mills, MD (US); Jeramy M. Marsh, Silver Spring, MD (US); Gregory S. Mendolia, Ellicott City, MD (US); Yizhen Lin, San Jose, CA (US)

(73) Assignee: Actiontec Electronics, Inc., Sunnyvale, CA (US)

( * ) Notice: Subject to any disclaimer, the term of this patent is extended or adjusted under 35 U.S.C. 154(b) by 0 days.

(21) Appl. No.: 10/843,677

(22) Filed: May 10, 2004

(65) Prior Publication Data

US 2005/0024268 A1 Feb. 3, 2005

Related U.S. Application Data

(60) Provisional application No. 60/469,317, filed on May 9, 2003.

(51) Int. Cl.
*H01Q 1/38* (2006.01)
*H01Q 21/12* (2006.01)
*H01Q 1/24* (2006.01)

(52) U.S. Cl. ..... 343/700 MS; 343/815

(58) Field of Classification Search ..... 343/700 MS, 343/702, 815, 817, 830
See application file for complete search history.

(56) References Cited

U.S. PATENT DOCUMENTS

| | | | | |
|---|---|---|---|---|
| 5,483,246 | A | 1/1996 | Barnett et al. | |
| 6,133,883 | A * | 10/2000 | Munson et al. | 343/700 MS |
| 6,476,766 | B1 | 11/2002 | Cohen | |
| 2004/0137950 | A1 * | 7/2004 | Bolin et al. | 455/562.1 |

* cited by examiner

*Primary Examiner*—Shih-Chao Chen
(74) *Attorney, Agent, or Firm*—Luce, Forward, Hamilton & Scripps LLP; Nicola A. Pisano, Esq.

(57) ABSTRACT

A multiband antenna includes at least two resonators that are driven directly and resonate in different frequency bands and a parasitically coupled resonator that resonates in one of the frequency bands. The coupled resonator is grounded with a conductive trace at one end and is thus not directly fed by the RF feed of the antenna. The coupled resonator increases the efficiency bandwidth near the frequency of operation for the coupled resonator. The antenna is fabricated from a stamped metal that is bent around or overmolded by a spacer layer. A clip formed integrally with the antenna by bending a portion of the ground plane permits attachment to the metal shield of the display of a laptop computer and is thus grounded along its length.

47 Claims, 16 Drawing Sheets

MULTIBAND ANTENNA WITH PARASITICALLY-COUPLED RESONATORS

This application claim the benefit of priority under 35 U.S.C. § 119(e) of U.S. provisional application Ser. No. 60/469,317, filed May 9, 2003.

BACKGROUND

1. Technical Field

This application relates generally to an antenna structure. More specifically, this application relates to an antenna that is responsive in at least two distinct frequency regimes whose resonators are coupled parasitically.

2. Background Information

Multiple frequency ranges have been allocated to handle the recent explosion of wireless communication devices and systems. Of the more recent devices, wireless communications devices such as laptop computers have been using the Bluetooth and 802.11 a/b frequency domains for wireless data transfer. Bluetooth, IEEE Standard 802.11 and the Japanese standard Hyperlan and their variants, are standards for wireless data communication. These standards are referred to collectively herein as 802.11a/b, although it will be recognized that some embodiments disclosed herein may be applied to other technologies as well. However, numerous problems exist with current antennas that must communicate in the 2.4 GHz and 5.2–5.8 GHz frequency domains specified by these standards.

One of these problems is the tradeoff between size and antenna efficiency: a relatively large size is necessary for a multi-frequency response antenna. Antenna performance must always be weighed against the size of the antenna. With any approach there will be a fundamental limit on the efficiency and bandwidth that can be achieved based on the total volume of the antenna. A smaller antenna is preferred for portable devices, such as laptop computers.

Traditionally, to gain more bandwidth in a particular band a matching network using lumped components is optimized, often in a pi or T network. However, with this solution, the achievable efficiency is limited to the realizable efficiency of the single element. Plus, the addition of lumped inductors and capacitors introduces loss.

Some of the best antenna solutions for 802.11a/b coverage in laptop computers presently are Planar Inverted F-Antennas (PIFAs). These narrow cross section antennas are designed to fit into very limited spaces around the display screen. However, PIFAs with very narrow cross sectional dimensions of 5 mm×5 mm or less have insufficient bandwidth to cover the 4.9 GHz to 5.85 GHz frequency range at a −10 dB return loss. To increase bandwidth to an acceptable range, the height or width of the PIFA must be increased beyond those permitted for installation near laptop computer displays.

A parasitic resonator has been used in conjunction with a PIFA to increase return loss bandwidth in handset antenna applications. This parasitic resonator is located above a ground plane and is coplanar with the PIFA. However, only the bandwidth of a single-band PIFA has been enhanced in this manner as typical handset applications. The single-band PIFA is both physically and electrically completely different from a PIFA that is designed to have a sufficient response in multiple frequency ranges. For example, if a lower frequency resonator is added, bandwidth is lost in the upper frequency range. Furthermore, emphasis in previous single-band PIFAs have been on a relatively wide and thin PIFA for handset form factors, which is incompatible with laptop computer use at least because of the stringent size requirements and thus design requirements in both. In addition, in the single-band PIFA with the parasitic resonator, the ground pin is located at an extremity of the antenna, i.e. the PIFA is fed conventionally.

Other 802.11b and/or Bluetooth antennas, which are also too large to fit next to laptop computer screens, include triband Bluetooth antennas for the 2.4/5.2/5.8 GHz bands from SkyCross, Inc., Melbourne, Fla., ranging in size from 20×18×3 mm to 22.3×14.9×6.2 mm. The smallest of these antennas appears to have an efficiency of better than 60% but has a poor Voltage Standing Wave Ratio (VSWR) of less than 3.0:1. The largest antenna is matched to better than a 2:1 VSWR but the efficiency is not listed (and is probably significantly lower due to the various tradeoffs involved in the design). Ethertronics, Inc., San Diego, Calif., offers a triband Bluetooth antenna that is only matched to −6 dB across the upper band (5.2–5.8 GHz) and has an estimated peak efficiency of 75% in the upper band (based on the return loss plot shown). Tyco Electronics Corporation, Wilmington, Del., also offers a circular triband Bluetooth Antenna with a diameter of 16 mm and a height of 6 mm. This antenna has a VSWR of better than 2.5:1 but like the larger SkyCross antenna has an unknown efficiency.

Thus, current multi-band antennas are not capable of meeting efficiency and overall compactness requirements for electronic devices, such as laptop computers, which use wireless communications in multiple frequency bands.

BRIEF SUMMARY

One advantage of this application is to create electrically small broadband antenna structures that enable wireless voice and data platforms that seek to cover multiple frequency bands for operation anywhere in the world. Another advantage of this application is to improve the combination of efficiency and compactness of multi-band antennas used in wireless communication devices. Another advantage of this application is to provide a multi-band antenna that is capable of being fastened to the wireless communication device in a cost and labor-efficient manner.

To at least these ends, a multiband antenna of a first embodiment comprises a radio frequency (RF) feed, a ground plane, at least two resonators containing a first resonator and a second resonator that are driven directly by the RF feed and resonate in different frequency bands, and at least one parasitically coupled resonator that is connected to the ground plane, coupled to the first resonator and the second resonator, and resonates near the frequency band of the second resonator. In a second embodiment, at least a portion of the ground plane is formed into a clip that is attachable to an external grounding sheet.

The multiband antenna is preferably fabricated from a single, thin pattern of stamped metal that is bent to form the first and second resonators, the coupled resonator, the ground plane, and the RF feed. The metal pattern is preferably bent to form a receptacle configured to retain a cable that feeds the RF feed.

The multiband antenna may contain a spacer layer separating the first and second resonators and coupled resonator from the ground plane, the first and second resonators and coupled resonator disposed on one surface of the spacer layer and the ground plane disposed on an opposing surface of the spacer layer.

Preferably the first resonator resonates in the 802.11b/Bluetooth frequency band and the second resonator resonates in or near the 802.11a frequency band (or other dual or more bands used in communication systems) and the multiband antenna has a form factor is such that the antenna is suitable for use in a laptop computer. The coupled resonator may be tuned at a slightly different frequency than the second resonator. The coupled resonator is preferably grounded at one end and acts as a quarter-wavelength transmission line. Preferably the coupled resonator and at least one of the first resonator and the second resonator are colinear. Preferably, the coupled resonator, the first resonator, and the second resonator are coplanar. In this case, the second resonator may be disposed between the coupled resonator and the first resonator. Alternatively, the coupled resonator may be partially surrounded by the first resonator such that a width of the combination of the coupled resonator, a portion of the first resonator adjacent to the coupled resonator, and spacing separating the coupled resonator and the portion of the first resonator is about equal to a width of the second resonator. In the latter case, the coupled resonator is preferably grounded at an end most distal from the radiating end of the first resonator.

The first resonator may have a reverse-fed configuration in which a radiating end of the first resonator is more proximate to a short between the first resonator and ground plane than to the RF feed. The first resonator, the second resonator, and the coupled resonator are preferably PIFAs.

In another embodiment, an antenna system comprises: an antenna containing at least one resonator that resonates in a desired frequency band and a ground plane; and at least one clip that is attachable to one of to an external grounding sheet and the ground plane.

In this embodiment, the antenna may be fabricated from a single, thin pattern of stamped metal that is bent to form the at least one resonator, the ground plane, and the at least one clip or may be formed separate from the antenna. The at least one clip may form a receptacle configured to retain a cable that feeds an RF feed that in turn feeds the at least one resonator. The at least one clip may be formed on an attachment device that further comprises at least one bracket containing a hole or that further comprises a base from which the at least one clip extends, the base having an area about the same as or larger than an area of the ground plane. The antenna may further comprise a spacer layer between the at least one resonator and the ground plane, the spacer layer having air gaps configured to allow the at least one clip to be attached to the ground plane. The antenna is preferably suitable for use in a mobile computing device. The clip may be a portion of the external grounding sheet.

In another embodiment, a method for improving efficiency of a multiband antenna includes forming a ground plane, forming at least two resonators that resonate at different frequency bands, connecting an RF feed to the at least two resonators such that a first resonator of the at least two resonators has a reverse-fed connection in which a radiating end of the first resonator is more proximate to a short between the first resonator and the ground plane than to the RF feed, and connecting the ground plane to a coupled resonator that is coupled to the first resonator and resonates at the frequency band of a second resonator of the at least two resonators. These may be done at the same time, e.g. by stamping the antenna from a thin metal sheet and bending the antenna to form the desired shape, or may be performed individually, e.g. using standard fabrication techniques (sputtering, soldering, etc. . .).

The method may further comprise forming the coupled resonator and the first and second resonators to be coplanar. In this case, the method may further comprise forming the second resonator between the coupled resonator and the first resonator or partially surrounding the coupled resonator by the first resonator such that a width of the combination of the coupled resonator, a portion of the first resonator adjacent to the coupled resonator, and spacing separating the coupled resonator and the portion of the first resonator is about equal to a width of the second resonator. In the latter case, the method preferably comprises grounding the coupled resonator at an end most distal from a radiating end of the first resonator.

DETAILED DESCRIPTION OF THE DRAWINGS AND THE PRESENTLY PREFERRED EMBODIMENTS

Figure 1:
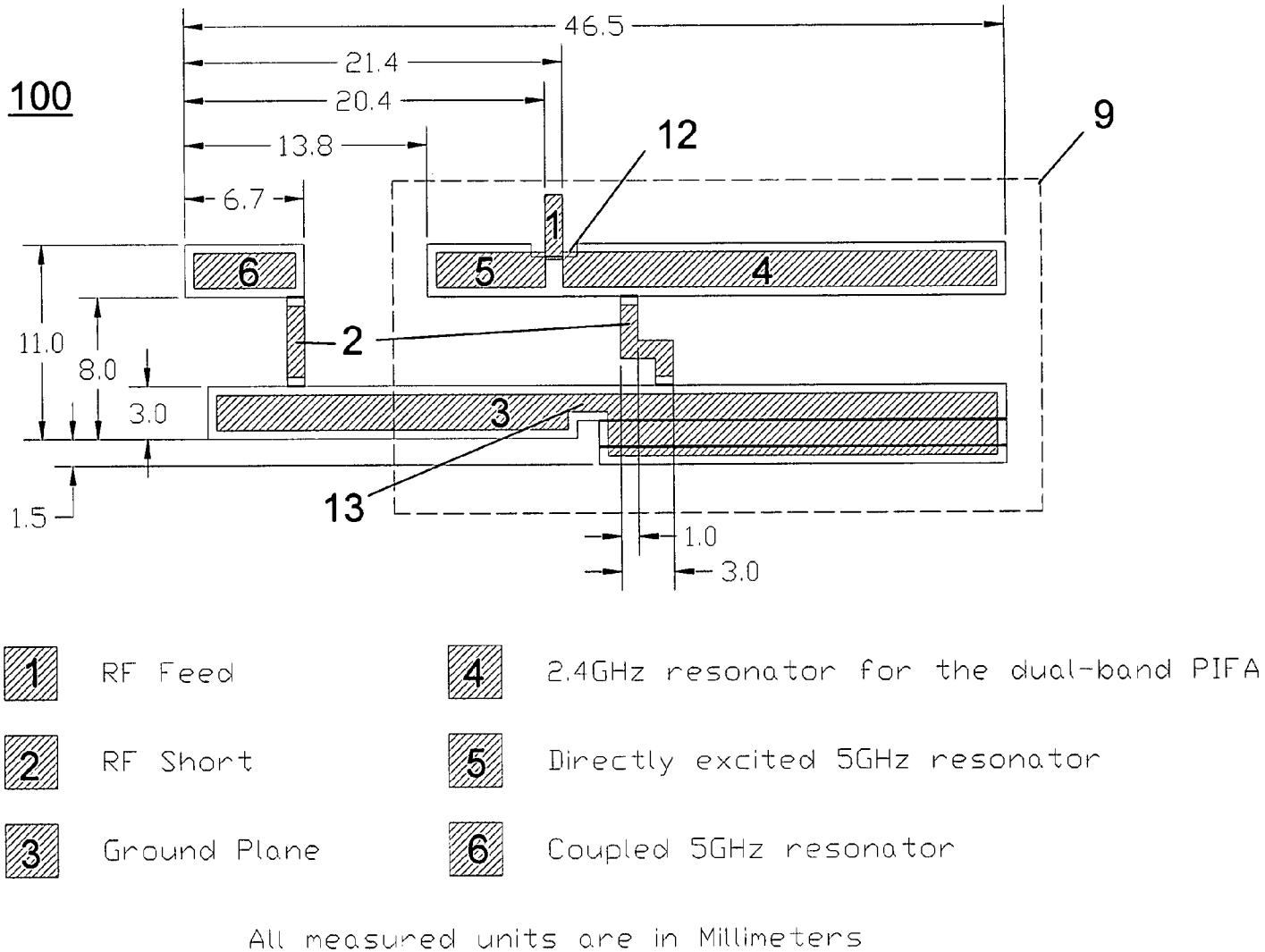
FIG. 1 is a schematic flat pattern of a first embodiment.

Although traditional approaches to improving bandwidth use matching networks of lumped elements, one embodiment of the present application realizes broadband antenna responses that introduce an additional radiating resonator rather than using lumped components. The present approach is not limited by the realizable efficiency of the original element because the coupled resonator will act as another radiator. The two resonators together will have a broader realizable efficiency curve than either resonator alone.

The triband antenna disclosed here is electrically very small for the efficiency bandwidth product it achieves. The bandwidth for the highband of a dual-band PIFA is enhanced while the antenna is a relatively narrow and tall PIFA for environments such as those of a laptop computer screen. In one embodiment, a reverse-fed PIFA is used, at least for the low band, in which the ground pin is located near the center of the PIFA rather than at the edge of the PIFA.

The antennas described here use an electromagnetically coupled resonant element (or resonator) to gain additional return loss and efficiency bandwidth near the frequency of operation for the coupled element. The electromagnetically coupled resonator is a finite length of coplanar metal acting as quarter-wavelength transmission line, since it is grounded with a conductive trace at one end. Hence this is a parasitic or coupled resonator since the antenna's feed trace does not touch it. The coupled resonator is coupled to a resonator that is directly fed and that is resonant in a lower frequency band than the coupled resonator. Of course, the addition of the coupled resonator may also decrease the bandwidth in the lower frequency band.

The coupled element can be tuned slightly higher or lower in frequency than the primary, directly fed resonator that resonates in the same or near the frequency band to produce an additional resonance in the return loss response. For one element to resonate near the frequency band of another element means that the antenna has two frequencies at which the return loss is a local minimum; the lower frequency is at most about 25% less than the upper frequency (or alternatively, the lower frequency of resonance is at most about 25% less than the upper frequency of resonance). Using this technique, and starting with elements that had approximately 650–700 MHz of 2:1 VSWR bandwidth near 5.5 GHz, the 2:1 dB VSWR bandwidth was approximately doubled by introducing a coupled resonator. The dimensions of the coupled resonator are important to achieving this increased bandwidth. Not only does the coupled resonator have to be resonant near the frequency band of interest but the Q of the coupled resonator must be substantially the same as the Q of the directly fed resonator in order to be able to achieve a 2:1 VSWR bandwidth improvement. If the coupled resonator were significantly closer to the ground plane it would create a high Q resonance that would not be able to produce a 2:1 VSWR improvement.

FIG. 1 shows the flat conductive (metal) pattern of a multiband antenna of one embodiment using a parasitically coupled resonator to increase the gain-bandwidth product of one band of the antenna. The 802.11a/b antenna 100 contains a parasitically coupled 5 GHz resonator 6. The portion of FIG. 1 contained within the dotted lines shows a dual-band PIFA 9 with a reverse fed 2.4 GHz PIFA 4 (or lower frequency resonator) and a conventionally fed (or driven) 5 GHz PIFA 5 (or upper frequency resonator). The 2.4 GHz PIFA 4 has a reverse fed configuration in which the radiating end of the 2.4 GHz PIFA 4 is more proximate to the short 2 between the 2.4 GHz PIFA 4 and the ground plane 3 than to the RF feed 1 (in this case by about 20%). The coupled resonator 6 and the upper frequency resonator 5 are about the same distance from the ground plane 3, and may be coplanar, along with the lower frequency resonator 4. In fact, as shown at least two, if not all of the resonators are colinear as well as being coplanar. This permits the resonators and thus antenna to be fit within an extremely narrow cross-sectional area, such as that required by laptop computer manufacturers.

The lower frequency resonator 4, upper frequency resonator 5, and coupled resonator 6 are all substantially rectangular with the same width. The lower frequency resonator 4, upper frequency resonator 5, and coupled resonator 6 are all patch antennas (with the directly driven resonators actually PIFAs). A notch 12 in the flat pattern is the dividing point between the lower frequency resonator 4 and the upper frequency resonator 5 into which the RF feed 1 is coupled. The shorts 2 are thin conductors that connect the resonators 4, 5, 6 with the ground plane 3. The ground plane 3 is substantially rectangular and has a thinner rectangle connected to a wider rectangle through a neckdown 13. The widths of the two rectangles of the ground plane 3 are about as wide and as long as (or wider or longer than) the resonators 4, 5, 6.

Two shorts 2 exist: the first short 2 connects the lower frequency resonator 4 to the ground plane 3 at about ⅕ of the length of the lower frequency resonator 4 from the RF feed 1, while the second short 2 connects the ground plane 3 to an end of the parasitically coupled resonator 6. The parasitically coupled element 6 is coupled to the directly fed upper frequency resonator 5 through free space. The shorted end of the parasitically coupled resonator 6 is located at the end nearest to the upper frequency resonator 5. However, in this embodiment the second short 2 may be moved to the farthest end of the coupled resonator 6 while realizing the same benefits and not substantially altering the overall length of the antenna 100. Although the first short is shown as being formed in an "S" shape and the second short is formed in a straight line, as long as conductive contact exists between the resonators and the ground plane, any shape may be used so long as the return loss is substantially optimized. The main factor for optimization depends on the particular frequency range of interest: for example, the main factor for the upper frequency resonator is placement of the short 2 and for the lower frequency resonator it is the dimensions (length/width) of the short 2.

Figure 2:
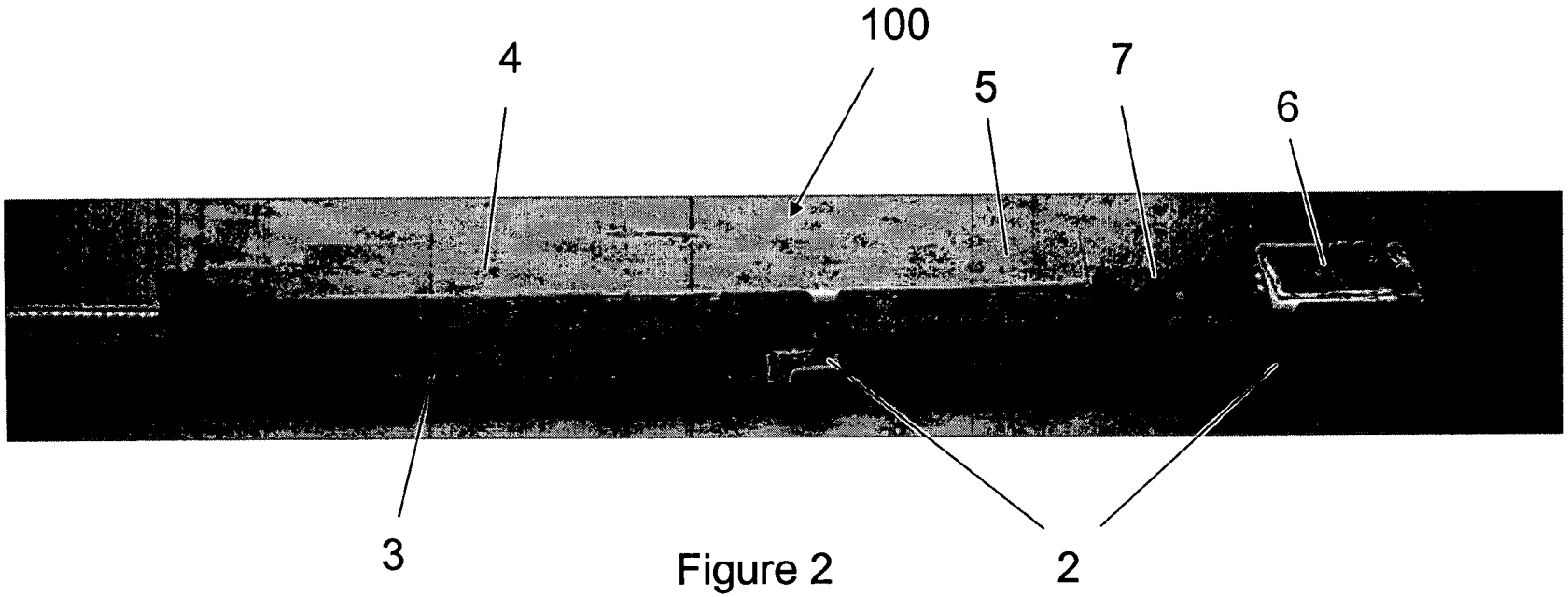
FIG. 2 is a perspective view of a construct of the first embodiment.
Figure 3:
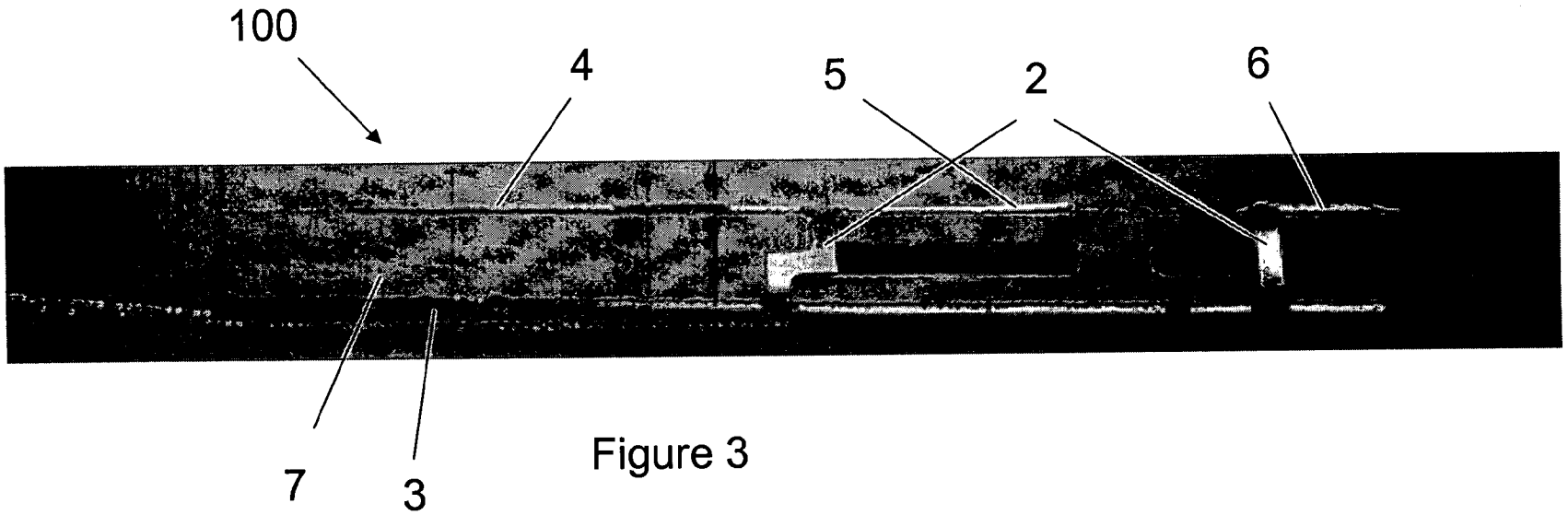
FIG. 3 is a side view of the construct of the first embodiment.
Figure 4:
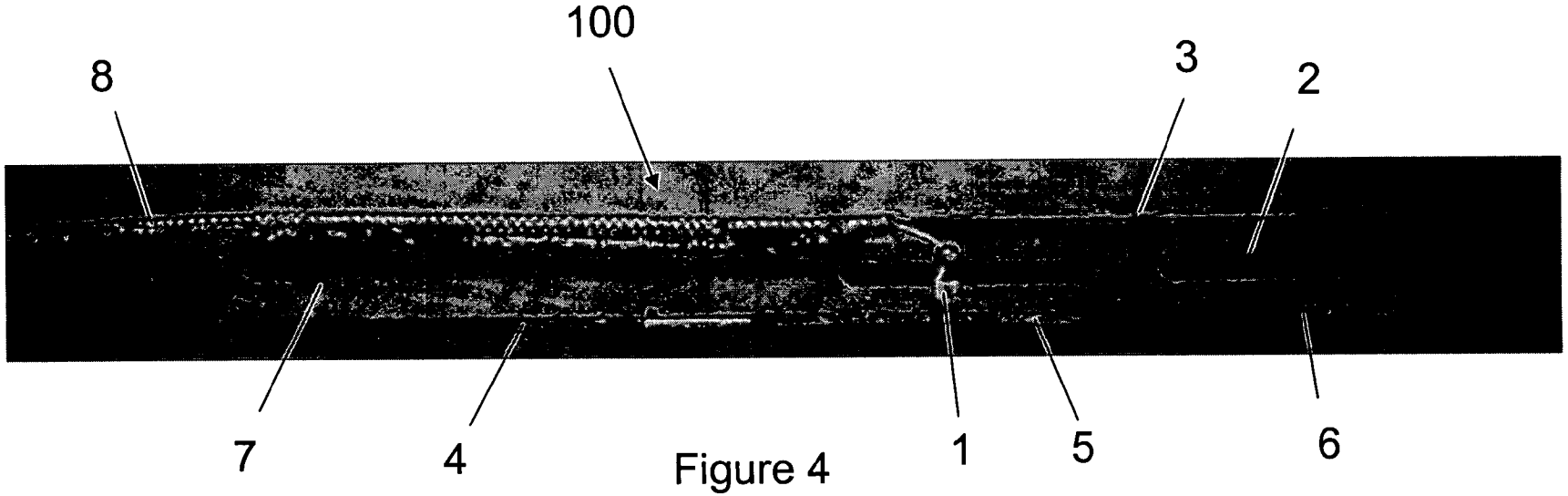
FIG. 4 is another side view of the construct of the first embodiment.

Although FIG. 1 illustrates the planar structure of the antenna 100, the antenna 100 is a three dimensional structure that is bent as shown in FIGS. 2–4. Thus, the materials that are used to fabricate the antenna 100 are preferably thin, lightweight, conductive, and flexible. Such a planar structure can be, for example, stamped from a thin piece of metal and then bent into the antenna shape. This is a simple, inexpensive means of fabricating the antenna. Of course, this is not the sole manner in which to fabricate the antenna. One of skill in the art will readily ascertain alternate methods to fabricate the structure, perhaps at the expense of additional component cost or time (for example, semiconductor processing techniques such as sputtering or deposition may be used, the metal pattern may be etched or silk screened on a flexible substrate which gets folded around a plastic or foam core, or traditional PCB processes may be used to create a surface mount version of this antenna).

Figure 10:
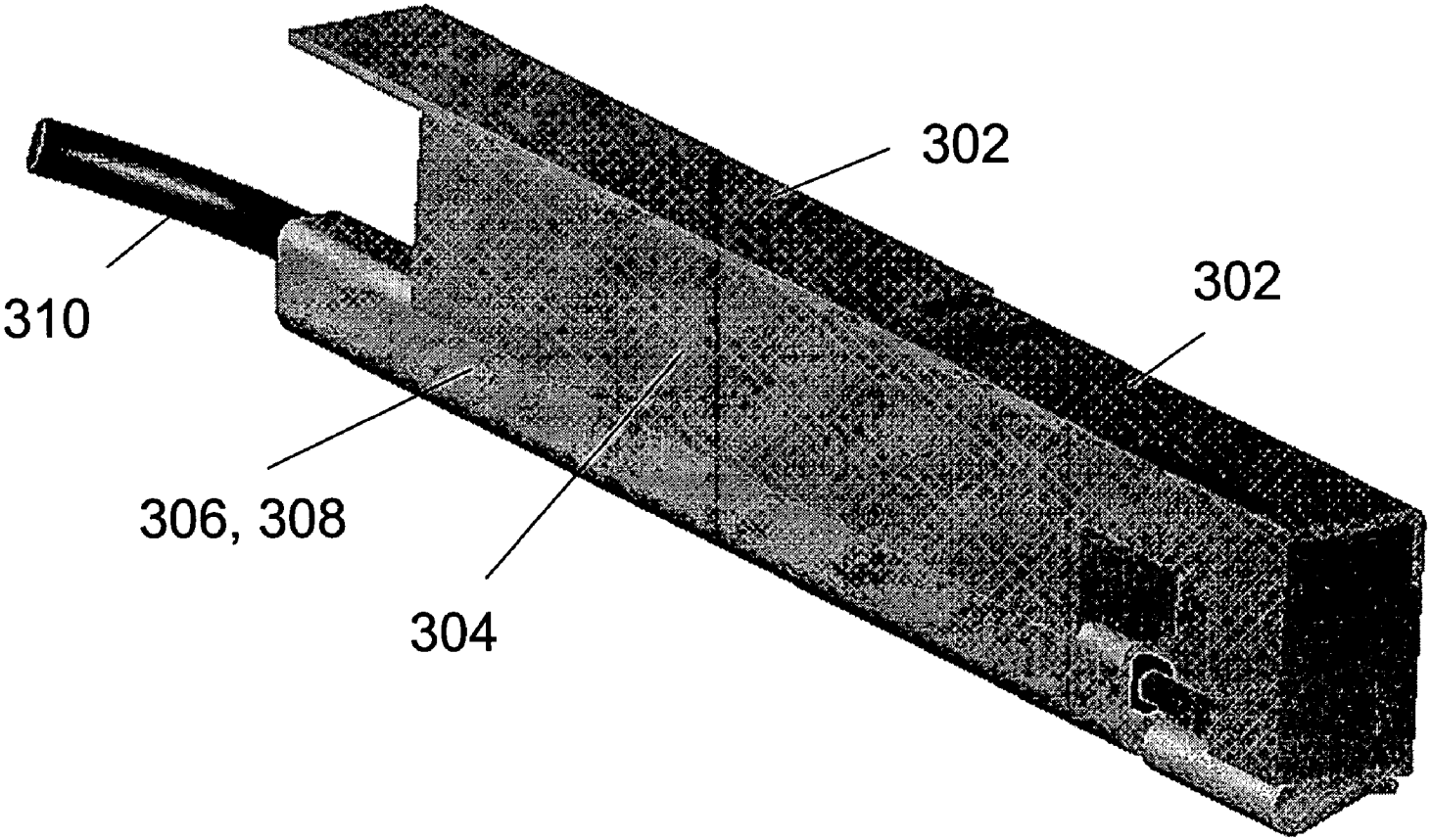
FIG. 10 is another perspective view of the construct of the third embodiment.

However, as illustrated in FIGS. 2–4, the flat pattern of FIG. 1 is bent around a polystyrene spacer layer 7 (see FIG. 2) to help define the antenna's overall height. The spacer layer separates the upper and lower resonators 4, 5 and coupled resonator 6 from the ground plane 3. The upper and lower resonators 4, 5 and coupled resonator 6 are disposed on one surface of the spacer layer 7 and the ground plane 3 is disposed on an opposing surface of the spacer layer 7. Although any low-permittivity spacer layer with sufficient physical stability can be used as the insert layer (such as plastic), the spacer layer may be omitted as long as the material used to form the flat pattern is physically robust enough to be used in the environment for which it is designed without compromising the structural integrity of the antenna. The thick horizontal lines in FIG. 1 indicate where the metal is bent to form the antenna 100. FIGS. 2–4 show a sample antenna structure with the flat pattern, spacer layer 7, and a coaxial cable 8 connected to the RF feed 1 that feeds signals to the RF feed 1. As shown in FIG. 4 (and more clearly in the embodiment shown in FIGS. 10 and 11), the ground plane 3 is bent so as to form a receptacle that is configured to retain the cable 8 (into which the cable 8 can be inserted). Although the cable 8 is itself shielded, this configuration serves to further shield and protect the antenna 100 from the cable 8, as well as providing a means for physically supporting the cable 8. In addition, the plastic spacer layer 7 could also be used to insure the cable 8 is placed the same way underneath the antenna.

The overall length of the antenna 100 in FIG. 1 is 46.5 mm, the width is 3 mm, and the thickness is 5 mm, making it compatible for use with laptop computers, for example. The ground plane 3 is substantially parallel with, and overlaps at least a significant portion of (i.e. >50%), if not substantially the entirety of, the resonators 4, 5, 6. In other embodiments, these physical dimensions may be altered to satisfy particular design goals.

Figure 5A:
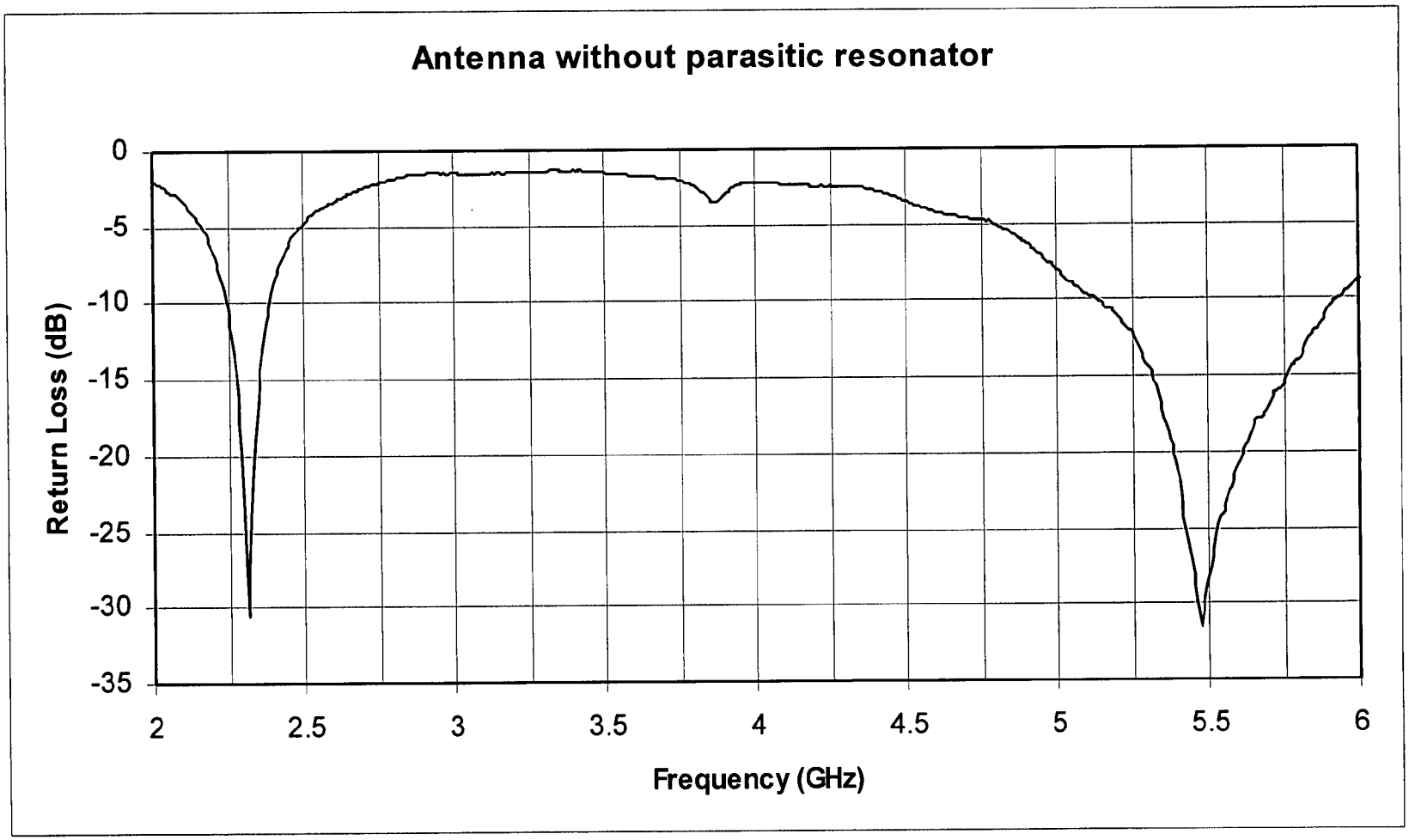
Figure 5a (prior art)
FIGS. 5*a* and 5*b* are plots of return loss and efficiency vs. frequency for a conventional antenna without the coupled resonator and for the construct of the first embodiment, respectively.
Figure 5B:
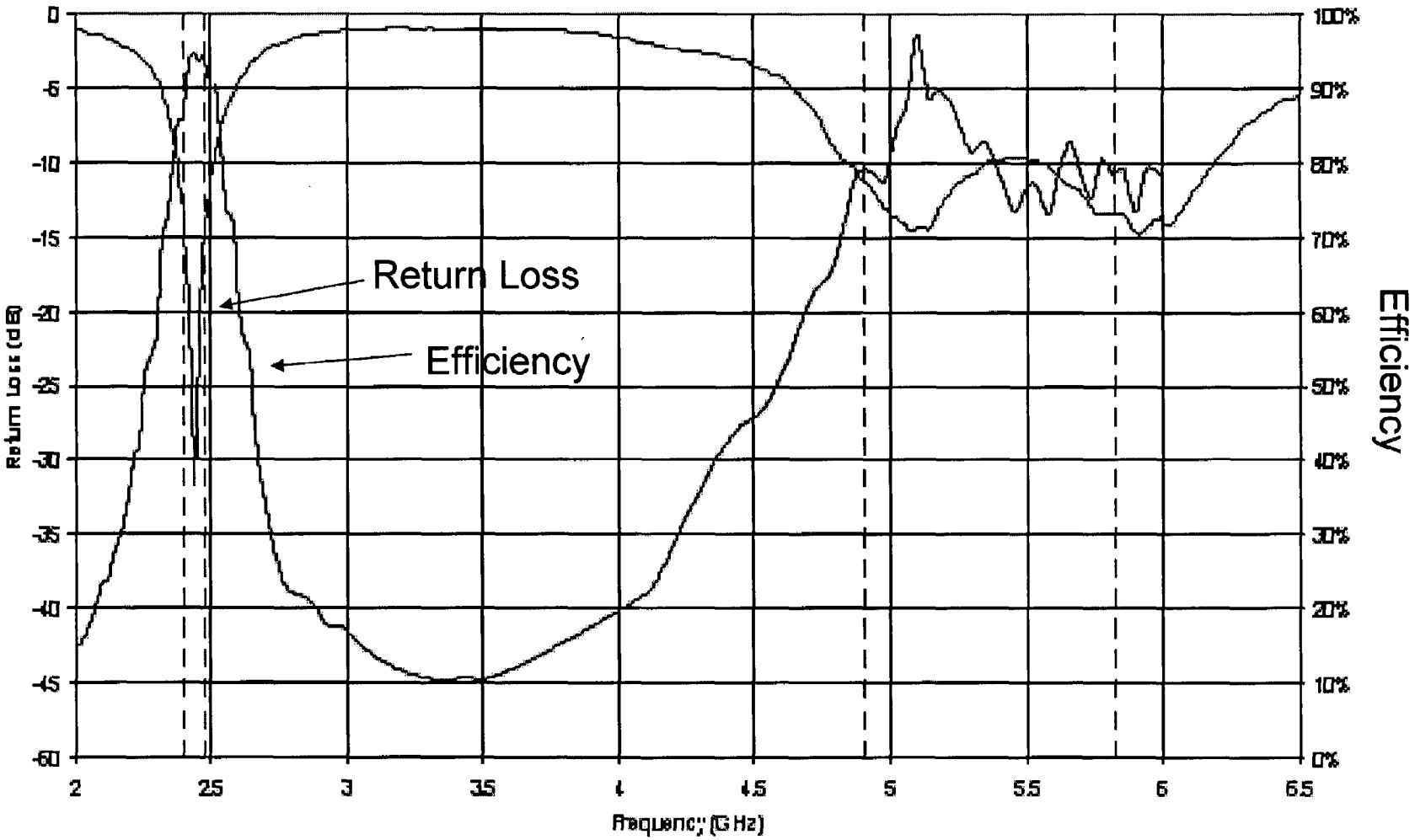

Such a design improves the 2:1 VSWR bandwidth over at least the 4.9 GHz to 5.825 GHz range. The coupled resonator 6 may be tuned at a different frequency than the driven resonator 5 operating in the same band. For example, the coupled resonator 6 may be resonant at approximately 5.2 GHz while the driven resonator 5 that is directly attached to the antenna feed 1 is tuned to be resonant close to 5.9 GHz. FIG. 5 shows the response of an antenna with such a configuration. The antenna response clearly shows a dual resonance between 5 and 6 GHz which was caused by adding the second resonant element. The antenna achieves a 2:1 VSWR over a span of 1.35 GHz centered at 5.55 GHz with over 70% efficiency over that entire range as measured on the edge of a laptop computer screen. A similar antenna without the coupled resonant element only achieves 700 MHz of 2:1 VSWR bandwidth. The dotted vertical lines shown in FIG. 5 indicate the edges of the 802.11a/b bands and the Japanese Hyperlan band. Without the additional parasitically coupled resonator there would not be enough 2:1 VSWR bandwidth to cover both 802.11a and the Japanese Hyperlan bands.

Figure 6:
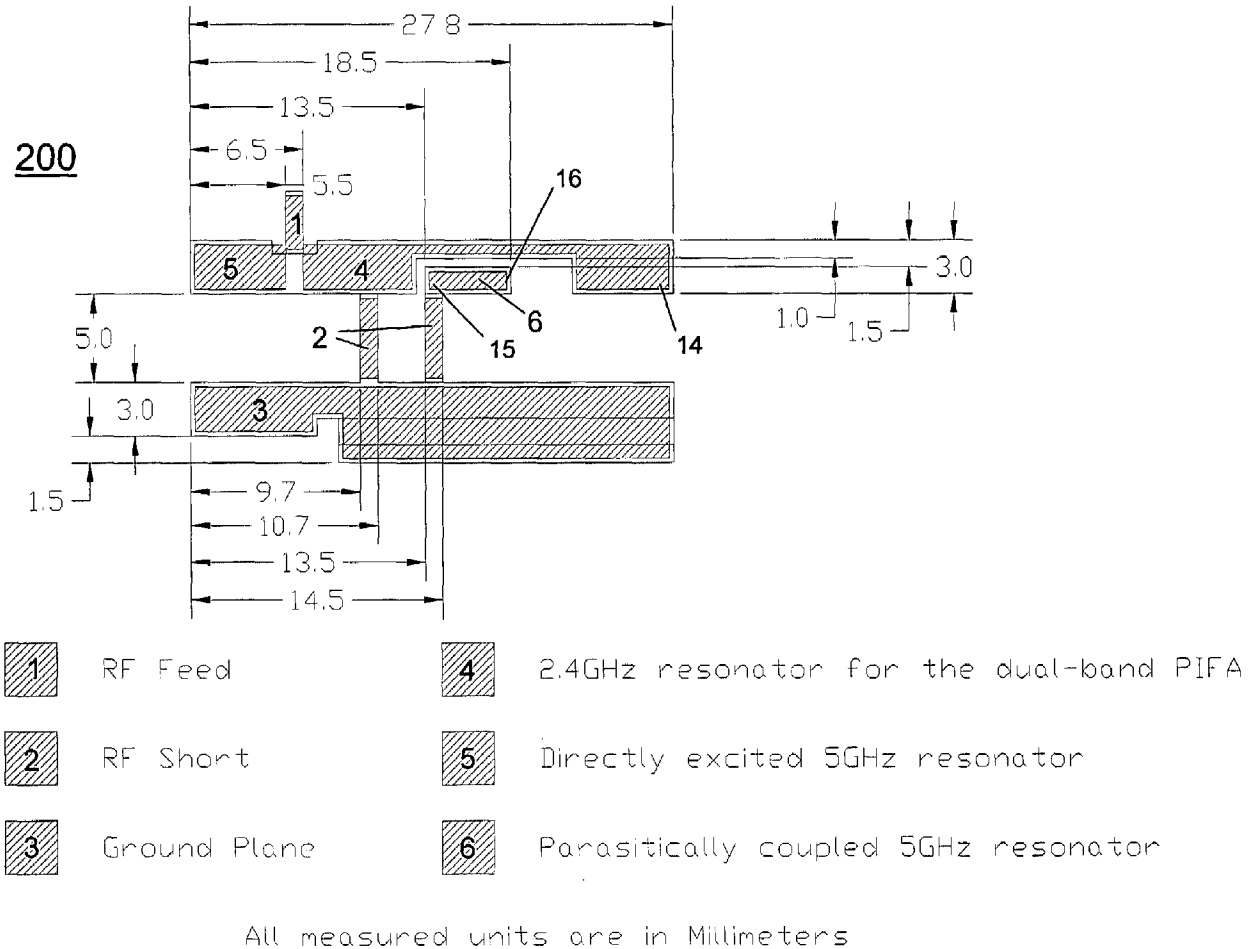
FIG. 6 is a schematic of a second embodiment.

Another embodiment of a multiband antenna in which more bandwidth is realized at the higher frequency resonance is shown in FIG. 6. The basic elements of this antenna 200 are the same as for the embodiment described above in conjunction with FIGS. 1–4 and thus the numbering remains the same accordingly. In FIG. 6, it is apparent that it is possible to place the parasitic element in closer proximity to the lower frequency element to achieve smaller form factors. In doing so, some bandwidth at the lower resonance is sacrificed to gain a considerable increase in bandwidth at the higher frequency. The smaller form factors (about 3 mm width, 27.8 mm length, and 5 mm thickness) permit the antenna 200 to be suitable for use in a greater number of laptop computers, whose design specifications are dictated by the manufacturers.

The antenna 200 shown in FIG. 6 is electrically similar to the antenna 100 shown in FIG. 1 in as much as the antenna 200 has two coupled high band resonators 5, 6 but the overall length has been reduced significantly from 45 mm to 28 mm. In addition, the parasitically coupled resonator 6 is significantly narrower than it was previously (1.5 mm vs. 3 mm, a 50% reduction) and is now a slightly higher Q resonator. This antenna 200 has less 2:1 VSWR bandwidth than the antenna 100 described in FIG. 1 at both the low and the high bands.

Unlike the antenna 100 of the previous embodiment in which the upper frequency resonator 5 is disposed between the coupled resonator 6 and the lower frequency resonator 4, the coupled resonator 6 in this embodiment is partially surrounded by the lower frequency resonator 4. The coupled resonator 6 is coupled to the low frequency resonator 4 through the gap between them. Thus the response and bandwidth of the antenna 200 is dependent on the gap distance (as well as being dependent on the overall width of the resonators). Because of the "embedding" of the coupled resonator 6 in the lower frequency resonator 4, the length of the overall length is significantly smaller than without embedding.

The 2.4 GHz resonator 4 in this embodiment rather than being substantially a single rectangle of conductive material (as in the first embodiment), is essentially formed from three smaller rectangles, two that have essentially the same dimensions and the third substantially thinner than and connecting the other two. The wider portions of the 2.4 GHz resonator 4 are about the same width as the driven 5 GHz resonator 5 and the ground plane 3 for matching purposes as well as size requirements dictated by the application. The parasitically coupled resonator 6 is disposed in parallel with the thin portion of the 2.4 GHz resonator 4. The thickness of the combination of the parasitically coupled resonator 6 and the thin portion of the 2.4 GHz resonator 4 is about equal to the thickness of the wider portions of the 2.4 GHz resonator 4, for the same reasons. As shown in FIG. 6, the thickness of the combination is somewhat less than the thickness of the wider portions so that the total thickness of the combination and the separation between the parasitically coupled resonator 6 and the thin portion of the 2.4 GHz resonator 4 is about equal to the thickness of the wider portions.

In this embodiment, the shorts 2 are straight connections (unlike the S shape shown in FIG. 1 for one of the shorts) between the different resonators and the ground plane, but are disposed at substantially the same relative locations of the resonators as those in FIG. 1. Although the short 2 that connects the coupled resonator 6 with the ground plane 3 may be disposed on either end of the coupled resonator 6, as in the previous embodiment, to minimize the length of the coupled resonator 6 and overall length of the antenna 2, the short 2 is preferably connected to the end 15 of the coupled resonator 6 most distal to the radiating end 14 of the lower frequency resonator 4 (i.e. the end of the lower frequency resonator 4 that is not connected to the RF feed 1). In addition, if the short 2 is connected to the end 16 of the coupled resonator 6 most proximate to the radiating end 14 of the lower frequency resonator 4, the lower frequency resonator 4 will lose bandwidth.

Figure 7:
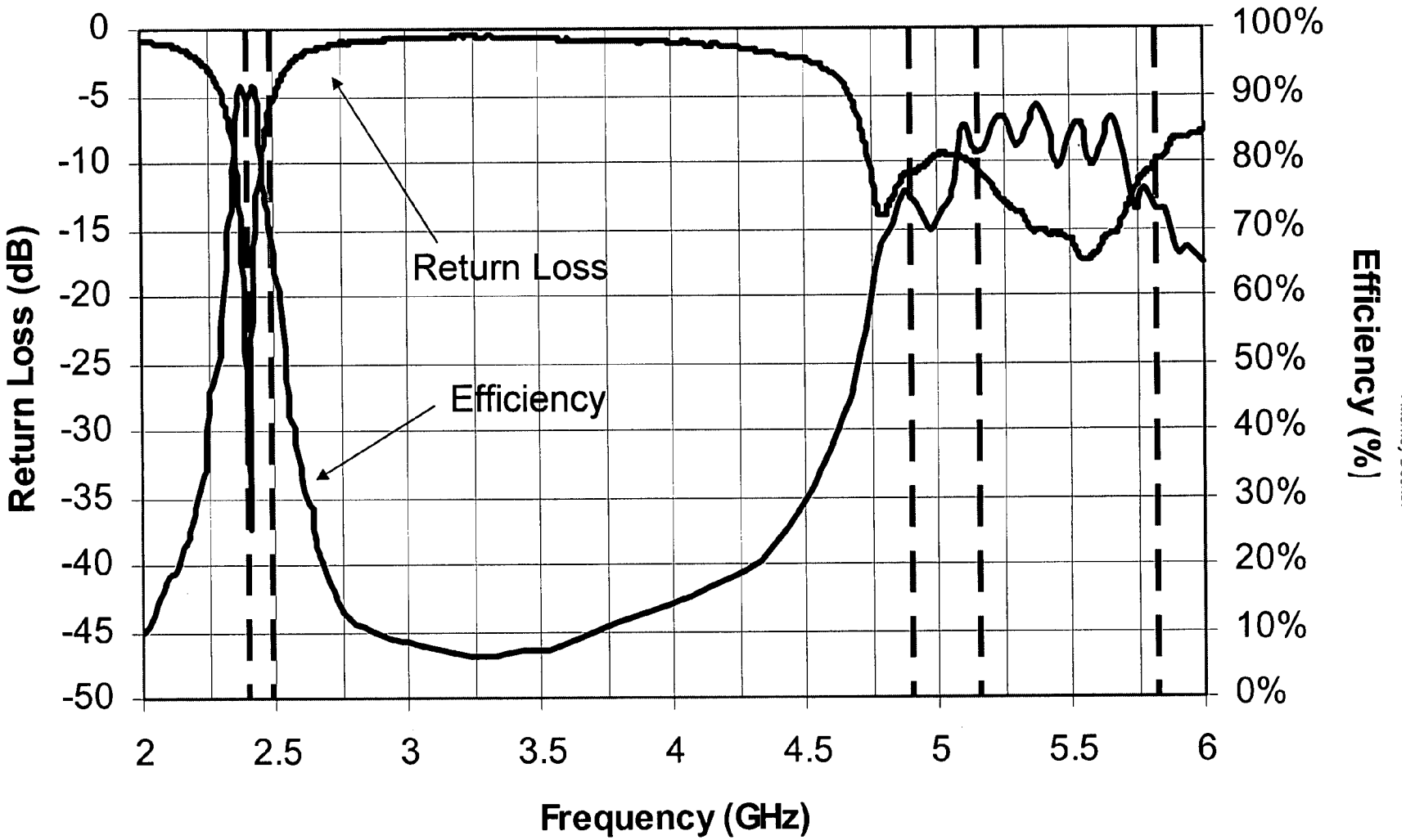
FIG. 7 is a plot of return loss and efficiency vs. frequency for the construct of the second embodiment.

FIG. 7 shows the Return Loss of the antenna 200 shown in FIG. 6. The antenna 200 has approximately 1.15 GHz of −9 dB Return Loss bandwidth centered at 5.4 GHz compared to the previous antenna 100, which had 1.35 GHz of −9.5 dB Return Loss bandwidth centered at 5.55 GHz. The 2.4 GHz resonance has also lost some bandwidth and now displays only 95 MHz of −10 dB Return Loss bandwidth compared to the previous antenna 100, which had 135 MHz of −10 dB Return Loss. Thus, a tradeoff exists: by at least partially circumscribing the parasitically coupled resonator 6 by the lower resonator 4, the antenna is significantly reduced in length (preferably at least about 40%) while the bandwidth at both bands is slightly reduced (preferably at most about 25%).

In different embodiments, which are not illustrated here, the coupled resonator is disposed adjacent to the radiating end of the lower frequency resonator, rather than being partially surrounded by the lower frequency resonator. In this case, the coupled radiator is once again separated from the lower frequency resonator by a small gap, and grounded at an end most distal to the radiating end of the lower frequency resonator. Although the lower frequency resonator and the coupled resonator may be rectangular, they preferably have shapes which interlock. For example, the lower frequency resonator and the coupled resonator may be formed from interlocking "L" shaped metal portions. Alternately, one of the lower frequency resonator and the coupled resonator may be formed in a "T" shape and the other in an interlocking "U" shape. In any of these cases, the width of the structure may remain about 3 mm at most, the length about 30 mm, and the thickness about 5 mm, thereby enabling the antenna to be used in a laptop computer.

Similarly, although the lower and upper frequency resonators are described as essentially rectangular, they may have an interlocking structure similar to the structures above.

Figure 8:
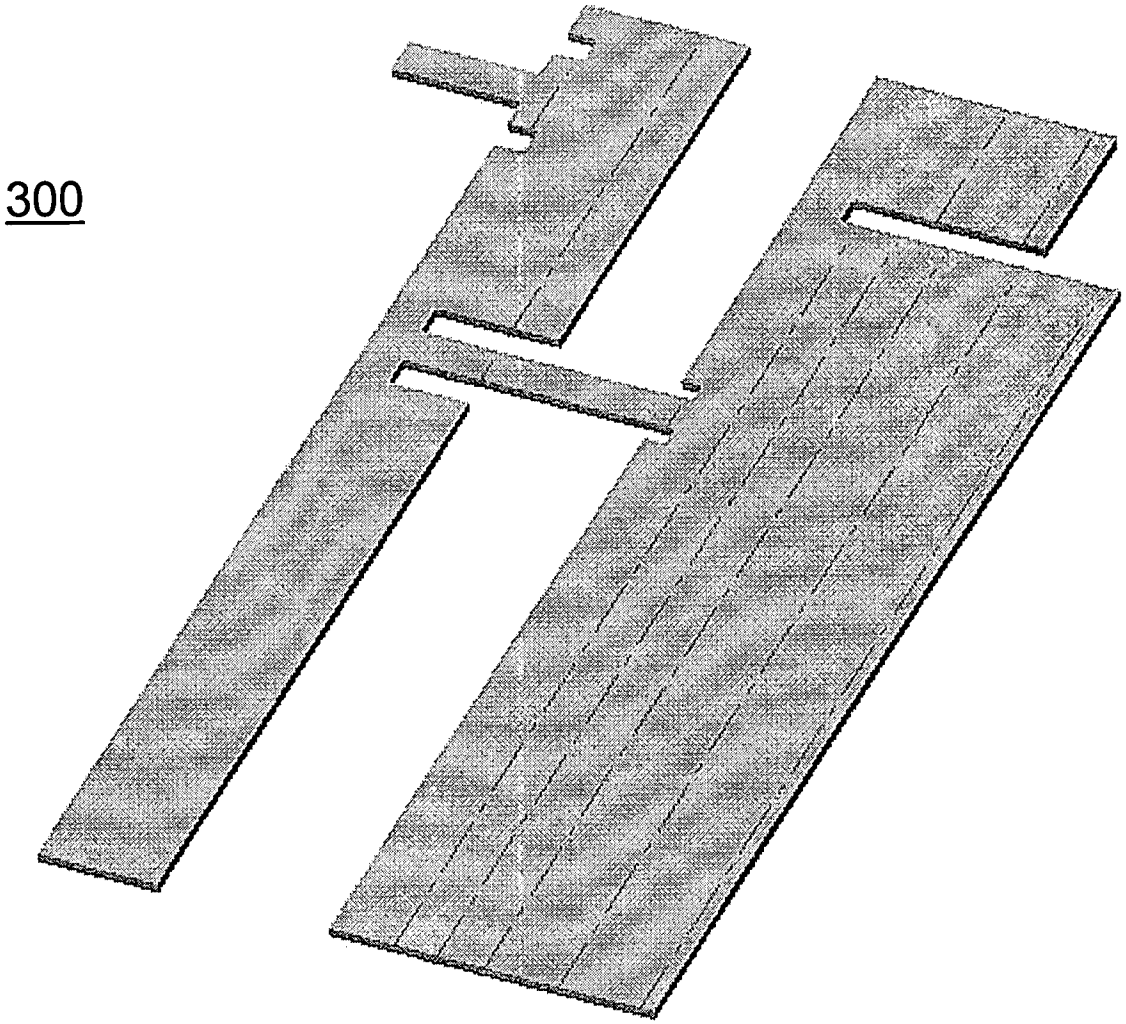
FIG. 8 is a schematic flat pattern of a third embodiment.
Figure 9:
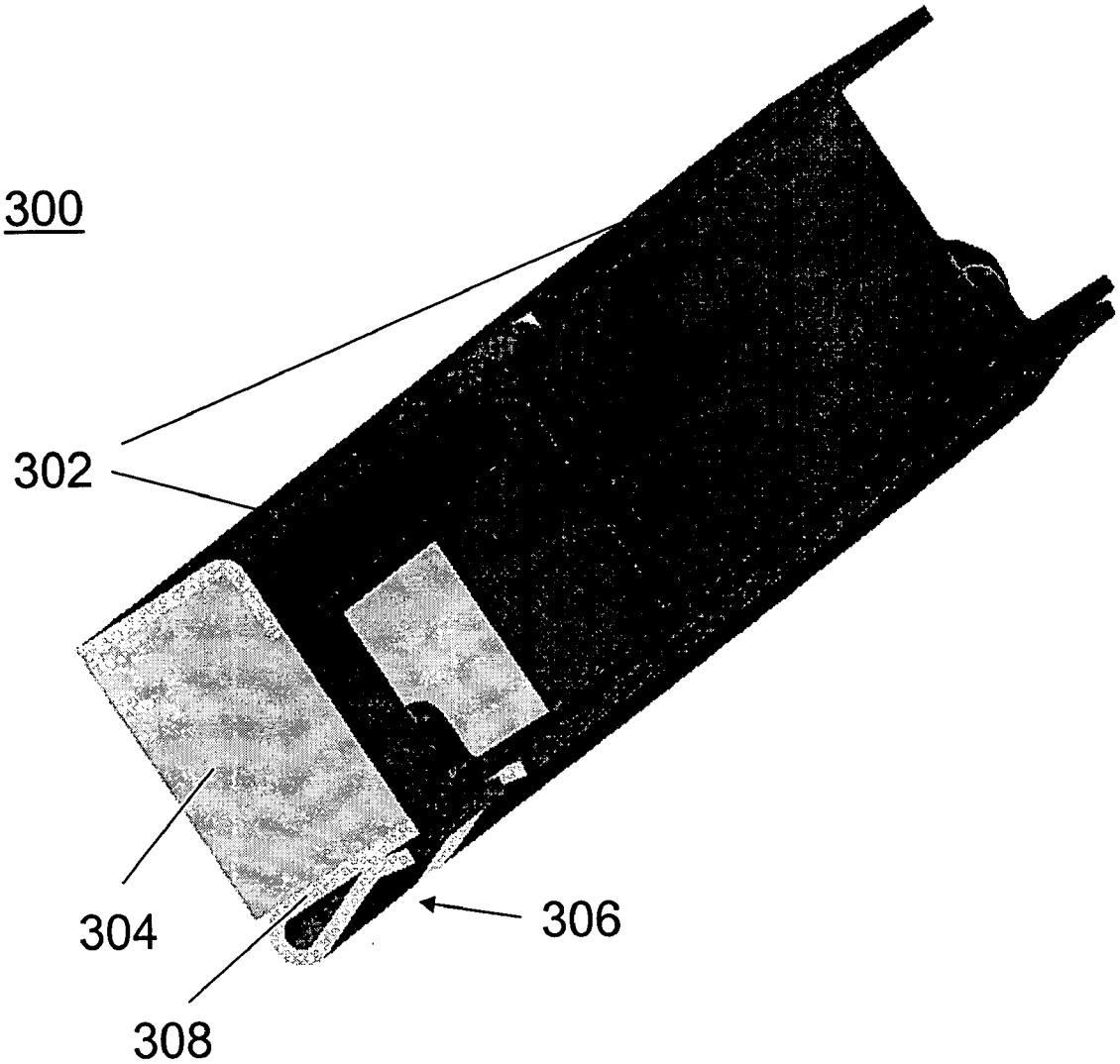
FIG. 9 is a perspective view of a construct of the third embodiment.

In another embodiment, shown in FIGS. 8–11, the antenna 300 contains a clip-on mounting feature (clip) that can be made of the same metal from which the antenna 300 is stamped. FIG. 8 shows the flat pattern as well as the lines along which the clip-on antenna 300 is bent after being stamped. FIG. 9 shows the clip-on antenna 300 after the flat pattern has been stamped, bent and plastic 304 has been injection molded around the metal lead frame, so that the resonators 302 and ground plane 308 are formed. Note that in FIGS. 9 and 10, the plastic spacer layer 304, fills in around the flat pattern so that portions of the connections between the resonators and ground plane and the resonators and the RF feed are, in effect, buried in the spacer layer. The clip 306 is integrally formed with the ground plane 308 and is attachable to a metal frame 320 (see FIG. 11) to ground the ground plane to the same potential as the metal frame 320. The clip 306 is also configured so that there is enough room in the curve back portion of the clip to capture the coaxial cable 310 feeding the antenna 300 and ensure that the cable 310 is always positioned in approximately the same manner near the antenna 300. The clip on antennas is suitable to be used in multiple mobile computing devices, e.g. a laptop computer, a tablet computer, a personal data assistant (PDA).

Figure 11:
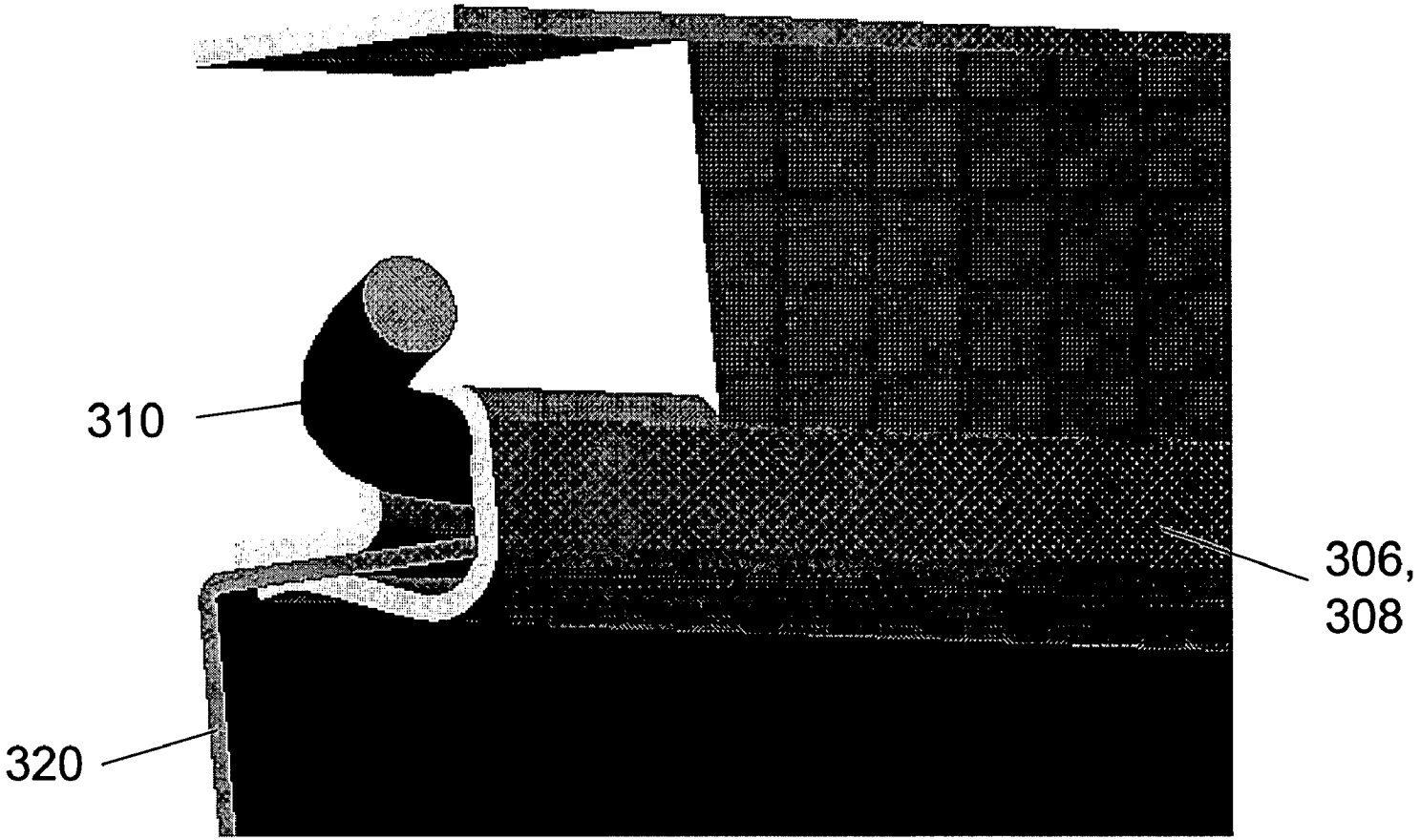
FIG. 11 is a close-up view of the third embodiment attached to a laptop computer.
Figure 12:
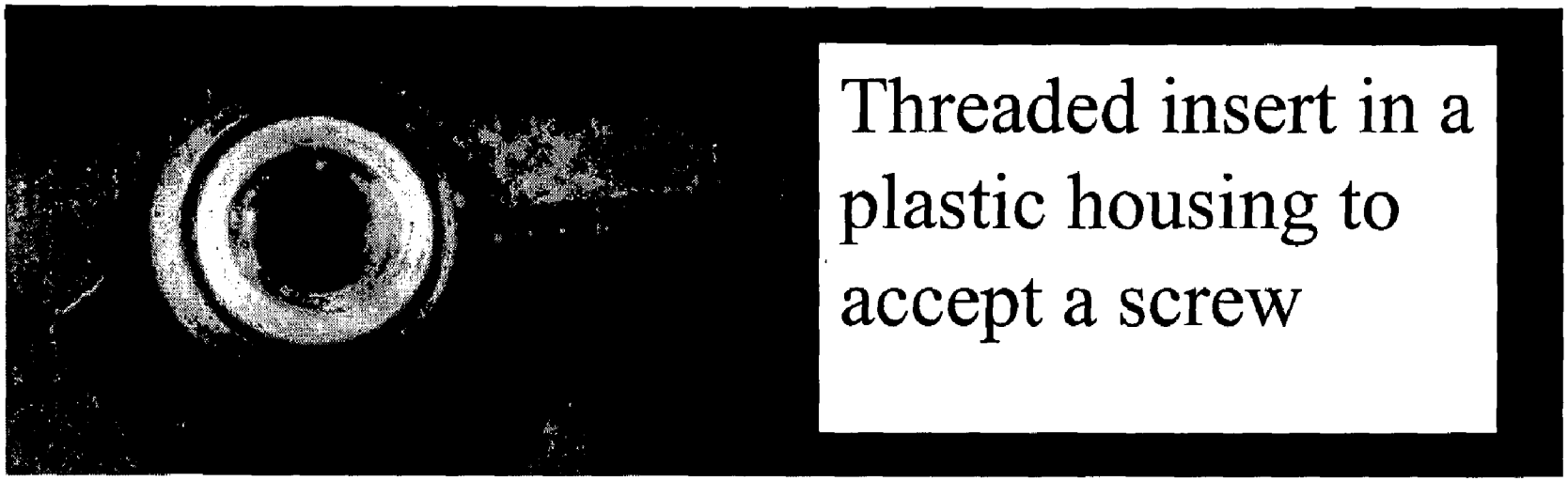
Figure 12 (Prior Art)
FIG. 12 is a conventional laptop computer to which a conventional antenna is attached.
Figure 13:
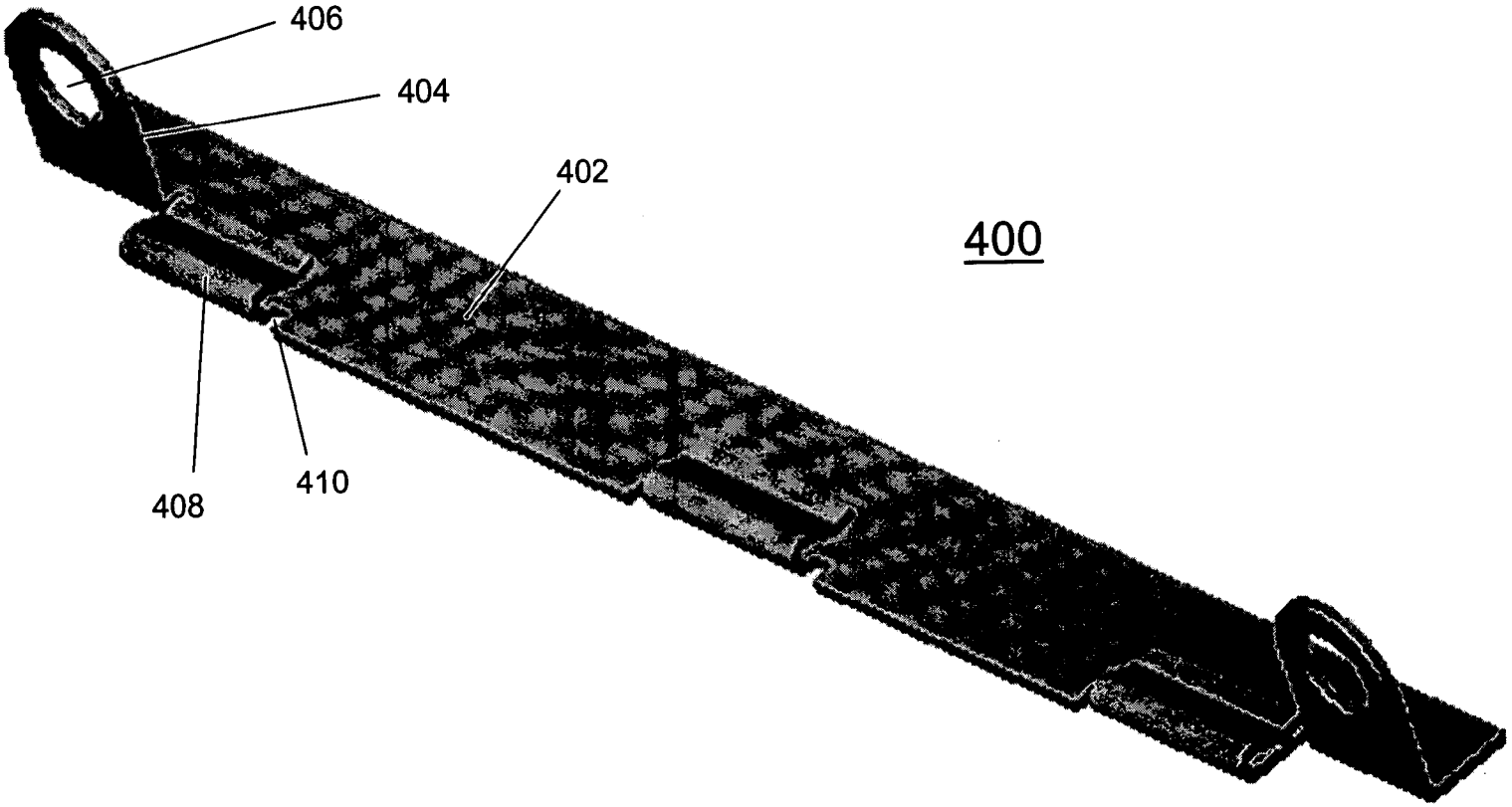
FIG. 13 is a perspective view of a fourth embodiment.

FIG. 11 illustrates one manner in which the clip-on antenna may be mounted above or beside the display screen in a laptop computer (not shown). Such a display screen can be a liquid crystal display, organic light emitter, plasma display, or any other material suitable for use in a laptop computer. Most laptop computers made have an EMI shield behind the display, which is usually made of a separate piece of stamped metal heat staked to the plastic case. The metal frame 320 is the shield behind the display on which the antenna 300 is mounted. As shown in FIG. 12, conventional laptop computers use a pair of screws in a pair of threaded inserts in a plastic housing to attach the antenna to the computer. In fact, most laptop computers have at least two antennas for diversity, which means that manufacturers must pay an assembler to put four additional screws as well as four threaded inserts in each laptop computer to retain the antennas. The clip antenna 300 saves both the cost of the screws and threaded inserts as well as the time it would take an assembly worker to put in the inserts and screws. Additionally if the antenna vendor wishes to ground the antenna through the screws, the laptop computer manufacturer would have to bring metal from the shield up to the screw holes for grounding. The clip antenna requires no such special consideration to achieve grounding. The clip thus has at least two advantages over conventional antenna mounting mechanisms: it provides an easy way to ground the antenna 300 along its full length and it eliminates screws that would normally be used to mount antennas for laptop applications. This saves both component cost as well as time (and thus cost) of integration of the antenna. Although FIG. 9 shows the clip 306 is integrally formed from the ground plane 308 (and metal pattern), the clip may be formed separately from the ground plane. FIG. 13 illustrates such an embodiment, in which the attachment device 400 is external to the antenna (not shown) so that the antenna attached to the attachment device 400 can accommodate multiple mounting styles. As shown in FIG. 13, the attachment device 400 contains a metal pattern that is stamped (or otherwise fabricated as above) to form a base 402, one or more brackets 404 having a hole 406, one or more clips 408, and notches 410 disposed around the clips.

In this embodiment, the antenna is securely fastened to the base 402 by the clip(s) 408. More particularly, the ground plane of the antenna is clipped to the base 402. Although three clips are shown, any number of clips may be used so long as the antenna remains securely fastened to the base 402. The brackets 404 are used to mount the antenna to the laptop computer through the holes 406 via screws, for example. Although the brackets 404 are shown as being bent at substantially a right angle to the base 402, the brackets 404 may be bent at any angle so long as the attachment device 400 is securely mounted to the computer and the antenna is securely mounted to the attachment device 400. In addition, the notches 410 are formed in the base 402 around the clips 408. The notches 410 permit the stamped metal that originally extends from the base 402 to be more easily bent to form the clips 408 shown in FIG. 13. The base 402 has an area about the same as or larger than the ground plane of the antenna.

Figure 14:
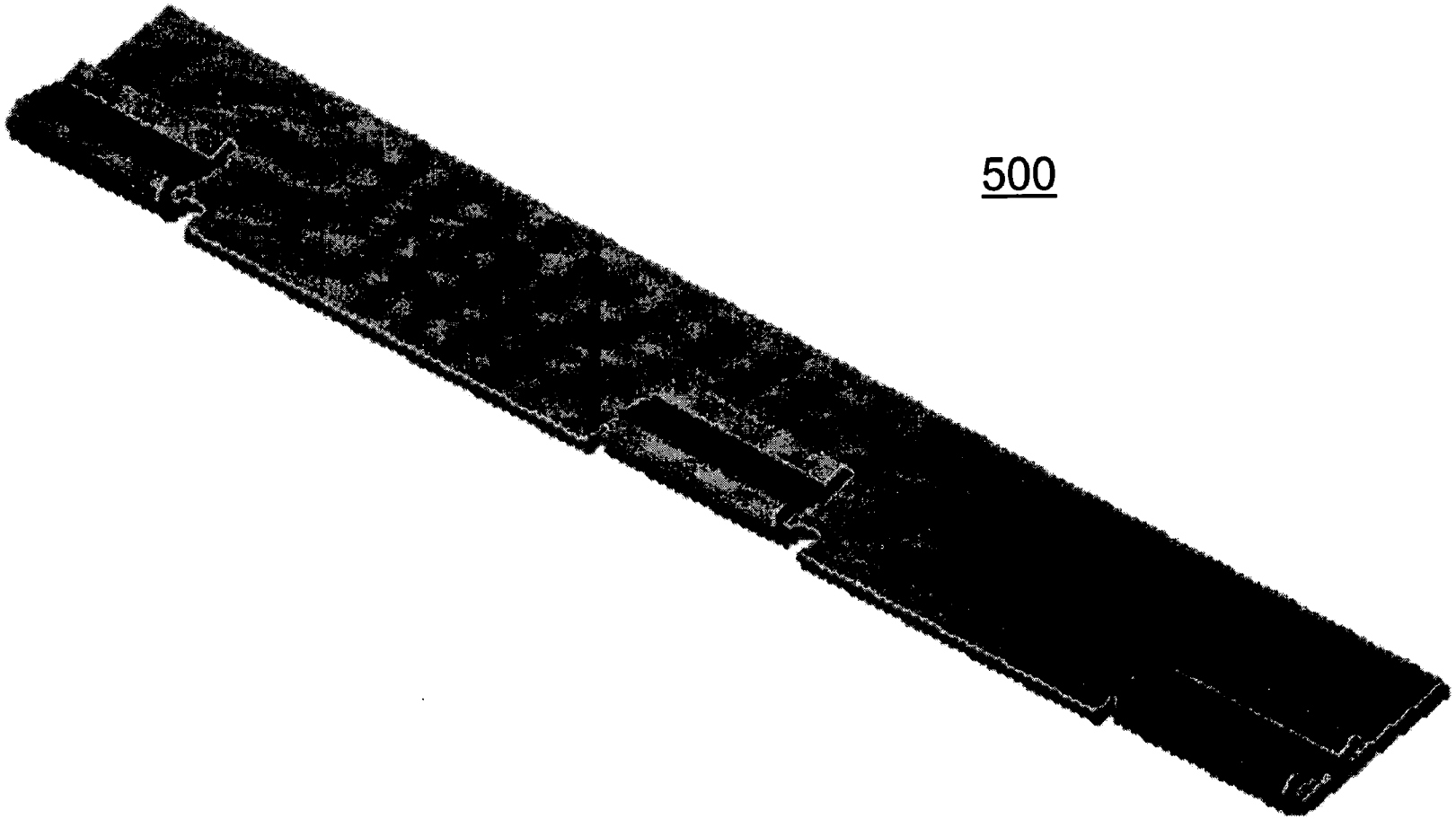
FIG. 14 is a perspective view of a fifth embodiment.

A tradeoff exists to forming the clip separate from the antenna, i.e. the clip is formed from a different piece of material than the antenna and is thus not integral with the antenna. While such an embodiment slightly increases the cost, the industrial designs of many more laptop computers may be accommodated while the arrangement is still able to offer customers the option of a simple push on mounting scheme. For example, the more traditional screw mounted design can be realized using the mounting bracket of FIG. 13. Alternatively, the brackets can be disposed of, as shown in FIG. 14, in which case the attachment device 500 may be attached to the case through soldering, or a conductive or non-conductive adhesive. Also, the clip may be provided on the EMI shield such that FIG. 14 shows a portion of the EMI shield that contains the attachment device 500 rather than an attachment device that is separate from the EMI shield.

Figure 15:
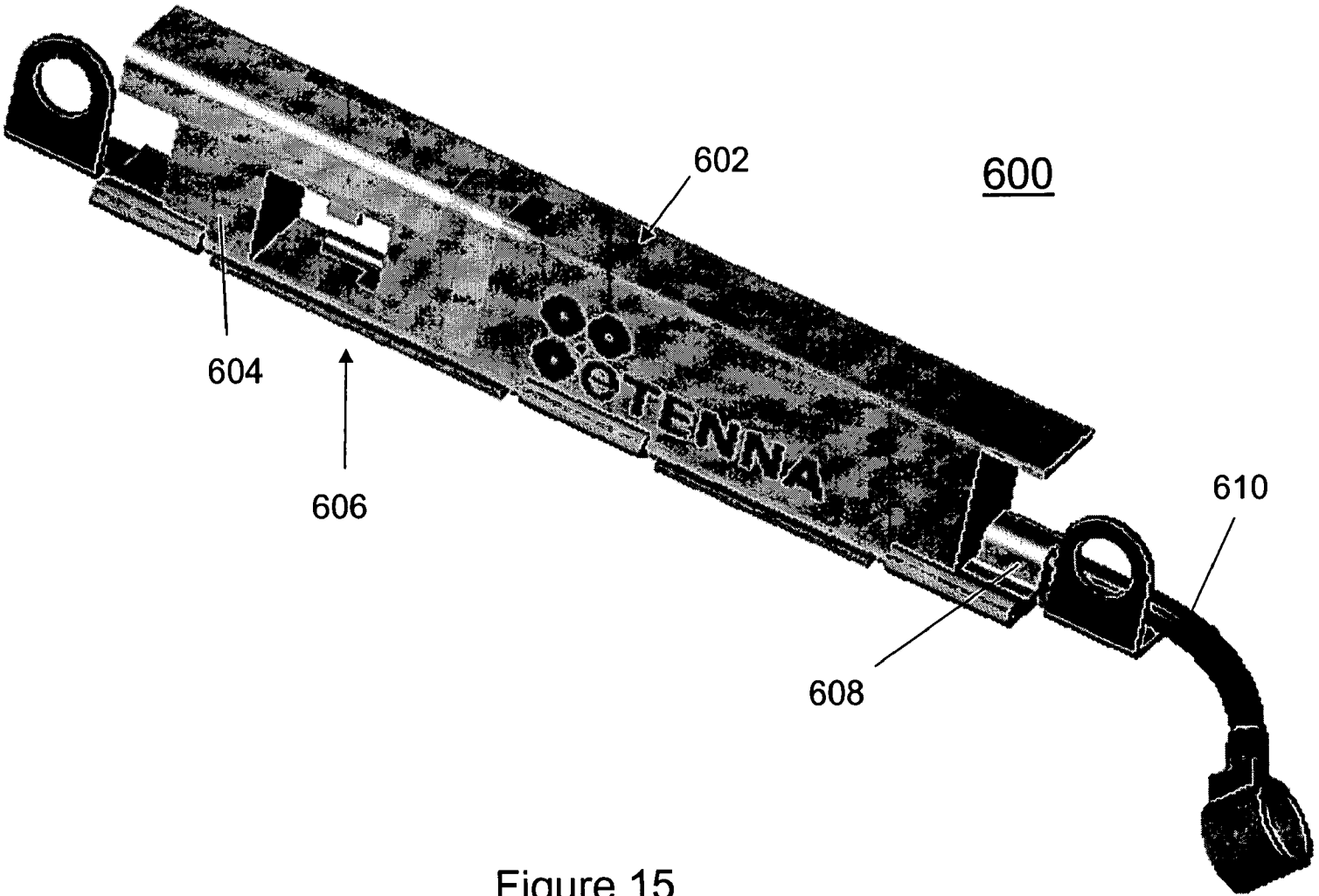
FIG. 15 is a perspective view of a sixth embodiment.

As shown in FIG. 15, the antenna design 600 for this mounting style has air gaps between the plastic spacer layer 604 and the antenna ground. This allows the clip of the attachment device 606 to be pushed onto the antenna 602 and connect the antenna 602 to the EMI shield behind the display. As shown, the cable 610 can be secured using a bracket 608 either formed from a separate piece of material or, similar to the previous embodiment, integral with the antenna 602.

Present embodiments shown and described herein improve the bandwidth of multiband antennas while reducing the size of the antennas by adding a coupled resonator having a frequency slightly lower than that of one of the two directly driven resonators (which in turn operate in different frequency bands). The coupled resonator is coupled to the resonator that is resonant in the frequency band other than the coupled resonator. Additional return loss and efficiency bandwidth near the frequency of operation for the coupled element is gained, which permits the antenna to be used in environments with stringent size as well as multiple wireless communication band requirements such as those of a laptop computer.

One skilled in the art may formulate similar antenna designs without altering the basic results or ideas behind the results. For example, while not shown, the reverse-fed PIFA may be normally fed: the coupling resonator can couple to any PIFA as it merely acts as extra way to excite resonances in one of the bands. It is therefore intended that the foregoing detailed description be regarded as illustrative rather than limiting, and that it be understood that it is the following claims, including all equivalents, that are intended to define the spirit and scope of this invention.

The invention claimed is:

1. A multiband antenna comprising:

an RF feed;

a ground plane;

at least two resonators, the at least two resonators containing a first resonator and a second resonator that are driven directly by the RF feed and resonate in different frequency bands; and at least one parasitically coupled resonator that is connected to the ground plane, electromagnetically coupled to the first resonator and the second resonator, and resonates near the frequency band of the second resonator, wherein Q of the coupled resonator is substantially the same as Q of the second resonator, and wherein the coupled resonator and at least one of the first resonator and the second resonator are colinear.

2. The multiband antenna of claim 1, wherein the antenna is fabricated from a single, thin pattern of stamped metal that is bent to form the first and second resonators, the coupled resonator, the ground plane, and the RE feed.

3. The multiband antenna of claim 2, wherein the metal pattern is bent to form a receptacle configured to retain a cable that feeds the RE feed.

4. The multiband antenna of claim 1, further comprising a spacer layer separating the first and second resonators and coupled resonator from the ground plane, the first and second resonators and coupled resonator disposed on one surface of the spacer layer and the ground plane disposed on an opposing surface of the spacer layer.

5. The multiband antenna of claim 1, wherein the first resonator resonates in the 802.11b/Bluetooth frequency band and the second resonator resonates in or near the 802.11a frequency band.

6. The multiband antenna of claim 1, wherein a form factor of the antenna is such that the antenna is suitable for use in a laptop computer.

7. The multiband antenna of claim 1, wherein the coupled resonator is grounded at one end and acts as a quarter-wavelength transmission line.

8. The multiband antenna of claim 1, wherein the coupled resonator is tuned at a slightly different frequency than the second resonator.

9. The multiband antenna of claim 1, wherein the coupled resonator and the first and second resonators are coplanar.

10. The multiband antenna of claim 9, wherein the second resonator is disposed between the coupled resonator and the first resonator.

11. The multiband antenna of claim 9, wherein the coupled resonator is partially surrounded by the first resonator such that a width of the combination of the coupled resonator, a portion of the first resonator adjacent to the coupled resonator, and spacing separating the coupled resonator and the portion of the first resonator is about equal to a width of the second resonator.

12. The multiband antenna of claim 11, wherein the coupled resonator is grounded at an end most distal from a radiating end of the first resonator.

13. The multiband antenna of claim 1, wherein the first resonator has a reverse-fed configuration in which a radiating end of the first resonator is more proximate to a short between the first resonator ,and ground plane than to the RF feed.

14. The multiband antenna of claim 1, wherein the first resonator, the second resonator, and the coupled resonator are patch antennas.

15. An antenna system comprising:

an antenna containing at least one resonator that resonates in a desired frequency band and a ground plane; and at least one clip that is attachable to an external grounding sheet or the ground plane, wherein the at least one clip is formed separate from the antenna and on an attachment device that further comprises at least one bracket containing a hole.

16. The antenna system of claim 15, wherein the antenna is fabricated from a single, thin pattern of stamped metal that is bent to form the at least one resonator, the ground plane, and the at least one clip.

17. The antenna system of claim 15, wherein the at least one clip forms a receptacle configured to retain a cable that feeds an RF feed that in turn feeds the at least one resonator.

18. The antenna system of claim 15, wherein the at least one clip is formed on an attachment device that further comprises a base from which the at least one clip extends, the base having an area about the same as or larger than an area of the ground plane.

19. The antenna system of claim 15, wherein the antenna further comprises a spacer layer between the at least one resonator and the ground plane, the spacer layer having air gaps configured to allow the at least one clip to be attached to the ground plane.

20. The antenna system of claim 15, wherein the antenna is suitable for use in a mobile computing device.

21. The antenna system of claim 15, wherein the clip is a portion of the external grounding sheet.

22. A method for improving efficiency of a multiband antenna comprising:

forming a ground plane;

forming at least two resonators that resonate at different frequency bands;

connecting an RF feed to the at least two resonators such that a first resonator of the at least two resonators has a reverse-fed connection in which a radiating end of the first resonator is more proximate to a short between the first resonator and the ground plane than to the RF feed; and connecting the ground plane to a coupled resonator that is coupled to a first resonator and a second resonator of the at least two resonators and resonates near the frequency band of the second resonator.

23. The method of claim 22, further comprising forming the coupled resonator and the first and second resonators to be coplanar.

24. The method of claim 23, further comprising forming the second resonator between the coupled resonator and the first resonator.

25. The method of claim 23, further comprising partially surrounding the coupled resonator by the first resonator such that a width of the combination of the coupled resonator, a portion of the first resonator adjacent to the coupled resonator, and spacing separating the coupled resonator and the portion of the first resonator is about equal to a width of the second resonator.

26. The method of claim 25, further comprising grounding the coupled resonator at an end most distal from a radiating end of the first resonator.

27. A multiband antenna comprising:

an RF feed;

a ground plane;

at least two resonators, the at least two resonators containing a first resonator and a second resonator that are driven directly by the RF feed and resonate in different frequency bands; and at least one parasitically coupled resonator that is connected to the ground plane, electromagnetically coupled to the first resonator and the second resonator, and resonates near the frequency band of the second resonator, wherein the first resonator has a reverse-fed configuration in which a radiating end of the first resonator is more proximate to a short between the first resonator and ground plane than to the RF feed.

28. The multiband antenna of claim 27, wherein the antenna is fabricated from a single, thin pattern of stamped metal that is bent to form the first and second resonators, the coupled resonator, the ground plane, and the RF feed.

29. The multiband antenna of claim 28, wherein the metal pattern is bent to form a receptacle configured to retain a cable that feeds the RF feed.

30. The multiband antenna of claim 27, further comprising a spacer layer separating the first and second resonators and coupled resonator from the ground plane, the first and second resonators and coupled resonator disposed on one surface of the spacer layer and the ground plane disposed on an opposing surface of the spacer layer.

31. The multiband antenna of claim 27, wherein the first resonator resonates in the 802.11b/Bluetooth frequency band and the second resonator resonates in or near the 802.11a frequency band.

32. The multiband antenna of claim 27, wherein a form factor of the antenna is such that the antenna is suitable for use in a laptop computer.

33. The multiband antenna of claim 27, wherein the coupled resonator is grounded at one end and acts as a quarter-wavelength transmission line.

34. The multiband antenna of claim 27, wherein the coupled resonator is tuned at a slightly different frequency than the second resonator.

35. The multiband antenna of claim 27, wherein Q of the coupled resonator is substantially the same as Q of the second resonator.

36. The multiband antenna of claim 27, wherein the coupled resonator and the first and second resonators are coplanar.

37. The multiband antenna of claim 36, wherein the second resonator is disposed between the coupled resonator and the first resonator.

38. The multiband antenna of claim 36, wherein the coupled resonator is partially surrounded by the first resonator such that a width of the combination of the coupled resonator, a portion of the first resonator adjacent to the coupled resonator, and spacing separating the coupled resonator and the portion of the first resonator is about equal to a width of the second resonator.

39. The multiband antenna of claim 38, wherein the coupled resonator is grounded at an end most distal from a radiating end of the first resonator.

40. The multiband antenna of claim 27, wherein the first resonator, the second resonator, and the coupled resonator are patch antennas.

41. An antenna system comprising:

an antenna containing at least one resonator that resonates in a desired frequency band and a ground plane; and at least one clip that is attachable to an external grounding sheet or the ground plane, wherein the at least one clip is formed on an attachment device that further comprises a base from which the at least one clip extends, the base having an area about the same as or larger than an area of the ground plane.

42. The antenna system of claim 41, wherein the antenna is fabricated from a single, thin pattern of stamped metal that is bent to form the at least one resonator, the ground plane, and the at least one clip.

43. The antenna system of claim 41, wherein the at least one clip forms a receptacle configured to retain a cable that feeds an RF feed that in turn feeds the at least one resonator.

44. The antenna system of claim 41, wherein the at least one clip is formed separate from the antenna.

45. The antenna system of claim 41, wherein the antenna further comprises a spacer layer between the at least one resonator and the ground plane, the spacer layer having air gaps configured to allow the at least one clip to be attached to the ground plane.

46. The antenna system of claim 41, wherein the antenna is suitable for use in a mobile computing device.

47. The antenna system of claim 41, wherein the clip is a portion of the external grounding sheet.

* * * * *